United States Patent [19]

Davis et al.

[11] Patent Number: 4,976,570

[45] Date of Patent: Dec. 11, 1990

[54] APPARATUS AND METHOD FOR GENERATING WAVES IN A BODY OF WATER

[75] Inventors: Walter R. Davis, Lebanon; Todd H. Nahrup, Loveland, both of Ohio

[73] Assignee: Water Parks, Inc., Mason, Ohio

[21] Appl. No.: 863,291

[22] Filed: May 15, 1986

[51] Int. Cl.[5] ..... F04H 3/16; F04D 35/00

[52] U.S. Cl. ..... 405/79; 4/491

[58] Field of Search ..... 405/79; 4/491

[56] References Cited

U.S. PATENT DOCUMENTS

| | | | |
|---|---|---|---|
| 3,562,823 | 2/1971 | Köster | 405/79 |
| 4,062,192 | 12/1977 | Biewer | 405/79 |
| 4,276,661 | 7/1981 | Baker | 405/79 |
| 4,406,162 | 9/1983 | Hark | 4/491 |
| 4,515,500 | 5/1985 | Bastenhof | 405/79 |
| 4,522,535 | 6/1985 | Bastenhof | 405/79 |
| 4,539,719 | 9/1985 | Schuster et al. | 4/491 |

FOREIGN PATENT DOCUMENTS

| | | | |
|---|---|---|---|
| 1008343 | 3/1983 | U.S.S.R. | 405/79 |

*Primary Examiner*—Dennis L. Taylor

*Attorney, Agent, or Firm*—Killworth, Gottman, Hagan & Schaeff

[57] ABSTRACT

A device and method for creating waves of water are provided. A movable wave-generating member is cyclically reciprocated in a body of water to create the waves. A chamber and baffle, positioned adjacent the wave-generating member, act to dissipate wave energy from the return stroke of the wave-generating member due to the entrapment and compression of air within the chamber.

6 Claims, 3 Drawing Sheets

APPARATUS AND METHOD FOR GENERATING WAVES IN A BODY OF WATER

BACKGROUND OF THE INVENTION

The present invention relates to an apparatus and method for generating waves in a body of water, and more particularly to an apparatus and method for generating such waves which includes means for effectively dissipating a portion of the wave energy so generated.

There are many types of artificial wave generation devices which are presently in use. Such devices are finding increasing use in recreational and aquatic parks to create waves in large swimming pools and the like. The dam break method pumps large quantities of water into a tank above the level of water in a pool. The water is then released suddenly to produce a surging wave along the length of the pool. Pneumatic wave generation devices operate by alternately blowing and venting an air plenum which is partially submerged in a tank of water. An opening at the bottom of the plenum, which is in communication with the water in the pool, allows the water to flow back and forth to produce waves in the pool. Another mechanical type of wave maker utilizes a wedge shaped plunger which is oscillated vertically to produce waves.

A wave generation device which has gained popularity in recent years is a hinged wave flap generator. In this device, which is explained in detail in Biewer, U.S. Pat. No. 4,062,192, a vertically-oriented wave flap hinged at its base at the bottom of a body of water is oscillated at the top by a hydraulic device. The period of the wave formed corresponds to the period of oscillation of the flap, and the wave height is determined by the amount the wave flap is displaced during each cycle. A somewhat similar device for creating waves, called a bulkhead wave generator, operates by moving a bulkhead, wave board, or wave flap back and forth beneath the water. Again, the period of oscillation and length of displacement affect the size and intensity of the waves which are formed.

One problem associated with hinged wave flap generators and bulkhead wave generators in the past has been the problem of dissipating the wave energy created by the return stroke of the wave flap. As these devices are located very near one end of a pool or the like, a large amount of energy must be dissipated in a relatively confined space. The Biewer patent teaches the use of a nonbuoyant material such as stainless steel shavings positioned behind the wave flap near the end of a pool or the like to absorb and dissipate the wave energy from the return stroke. Others have utilized collections of absorbent foam materials, corrugated plastic field tile, and the like positioned behind the wave flap in an attempt to absorb and dissipate the wave energy. None of the above solutions has been very satisfactory. Either the energy from the water waves is not adequately dissipated and the end wall of the wave pool or the like is subjected to periodic potentially damaging vibrations or the energy dissipating material, which is repeatedly subjected to strong forces, dislodges or breaks up.

Accordingly, there is still a need in this art to provide a method and device which will efficiently dissipate the wave energy which results from the return stroke of a wave flap or the like in a wave generation device.

SUMMARY OF THE INVENTION

The present invention meets that need by providing an apparatus and method which efficiently dissipates wave energy generated during the return cycle of a wave flap in a wave generating device. While the invention is described with reference to hinged wave flap wave generators, the invention is also believed to have use for bulkhead wave generating devices.

In a hinged flap wave generation device, there is generally a movable wave generating member or flap, hinged at its base, and means for cyclically reciprocating the wave generating member in the water to create a series of waves. Applicant's invention includes means positioned adjacent and behind the wave generating member near the end of a pool or the like for dissipating the wave energy generated during reciprocation of the member. Such means include an overhang or baffle which, with the foundation of the pool, forms a chamber for containing air behind the device. Upon the return stroke of the wave generating member, the water moved by the member is forced into the chamber. The air trapped in the chamber is compressed by the force of the water and acts as an air cushion to effectively dissipate the wave energy. Potentially damaging vibrations are substantially eliminated.

Preferably, the overhang or baffle extends below the water level in the pool. However, the baffle must extend downwardly a sufficient distance so that it will act to seal off air in the chamber as the water level rises on the return stroke of the wave generating member. Additionally, one or more valves or open ports can be positioned in the baffle or elsewhere within the chamber to control the release of air trapped within the chamber and/or the flow of air into the chamber. By controlling the amount of air flowing out of the chamber, it is believed that the energy dissipated can be optimized.

Accordingly, it is an object of the present invention to provide an apparatus and method for dissipating wave energy produced by the return stroke of a wave generating member in a device for generating waves of water. This and other objects and advantages of the invention will become apparent from the following detailed description, the accompanying drawings, and the appended claims.

DESCRIPTION OF THE PREFERRED EMBODIMENTS

Figure 1:
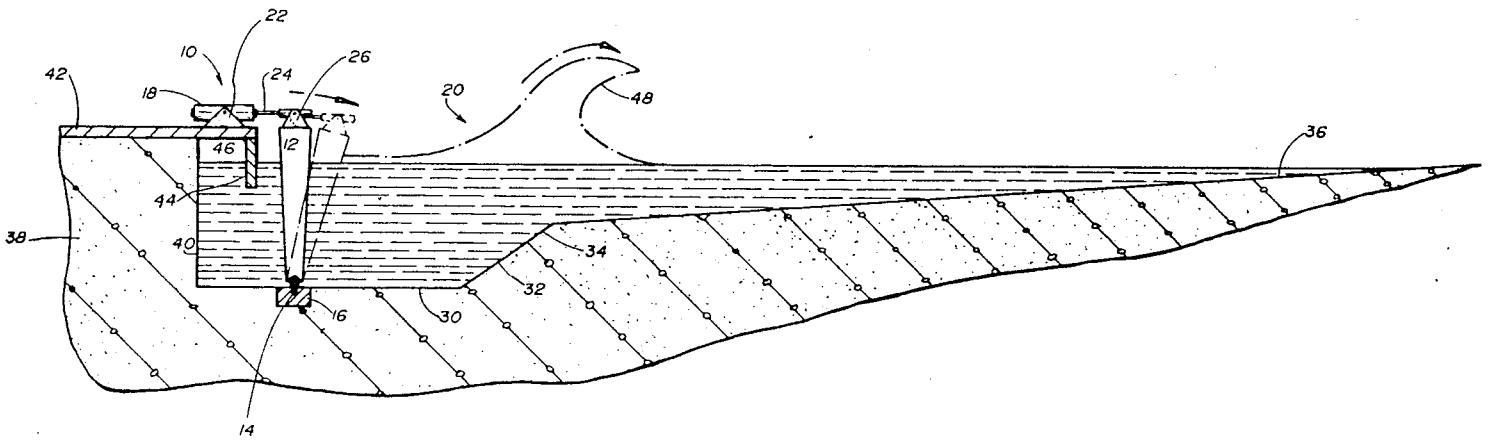
FIG. 1 is a schmematic, sectional side view of the invention utilized in a pool of water having a shoal.

Referring now to FIG. 1, a hinged flap wave generator 10 is illustrated near one end of a man-made pool, generally indicated at 20. The pool floor 30 generally inclines as shown at 32 to form a shoal 34. The level of water pool 20 generally declines from left to right until it reaches shore 36. The cyclic reciprocation of the wave generating device causes waves to form and roll up upon the shore 36. A typical wave 48 is illustrated in phantom lines in FIG. 1. While the invention is illustrated with reference to a hinged flap wave generation device, it is believed that the invention also may have utility with bulkhead wave generation devices. Additionally, while the invention is described with reference to a man-made pool, it will be apparent that the present invention may have utility in natural bodies of water where wave generation devices are installed.

Figure 3:
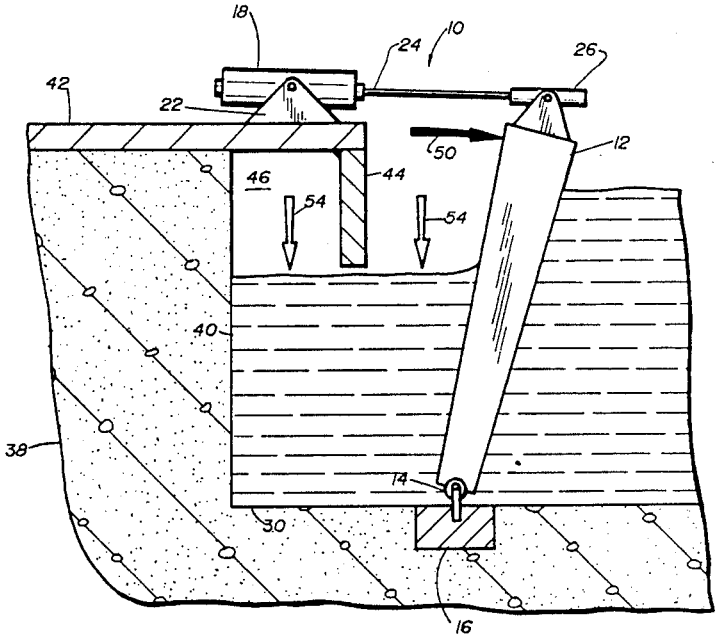
FIG. 3 is a fragmentary sectional view similar to FIG. 2, but illustrating the forward stroke of the device of the present invention.
Figure 4:
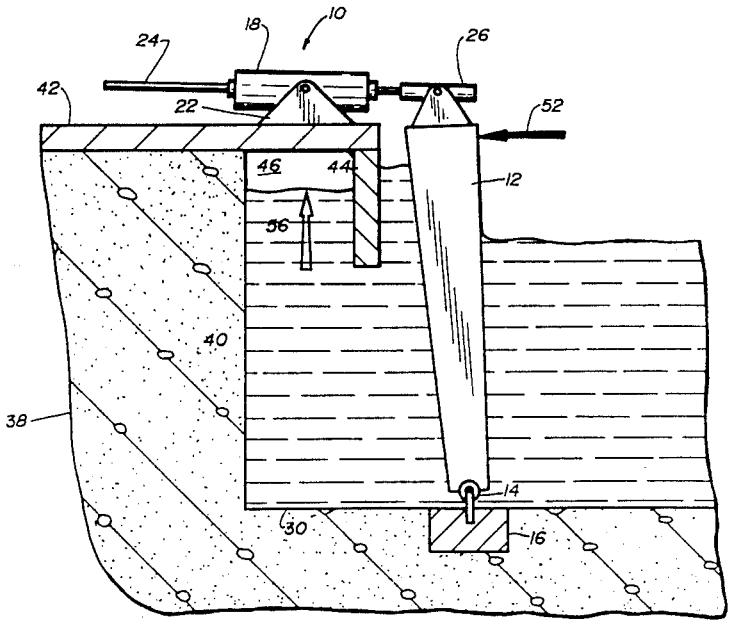
FIG. 4 is a fragmentary sectional view similar to FIGS. 2 and 3, but illustrating the return stroke of the device of the present invention.

Wave generating device 10 includes a movable wave generating member or flap 12 which is cyclically reciprocated as best illustrated in FIGS. 3 and 4 to create waves. Wave generating member 12 is pivotally attached by pivot 14 to a stationary anchor 16 that is fixed on the pool floor 30. Hydraulic cylinder 18, driven by a motor (not shown), is pivotally mounted on a base 22 on platform 42 which overhangs foundation 38 of the pool. The ram 24 of hydraulic motor 18 is connected by a pivot 26 to the top portion of wave generating member 12. The wave generating member or flap 12 is reciprocated by reciprocation of ram 24.

As shown in FIG. 1, the wave generator is interposed between the end 40 of pool 20 and shoal 34. The cyclic reciprocation of wave generating member 12 causes waves to be generated and moved toward shoal 34. As described in further detail in Biewer, U.S. Pat. No. 4,062,192, the disclosure of which is hereby incorporated by reference, the size and duration of the waves generated can be controlled in a known manner. Additionally, more than one wave generating device can be located in pool 20. Individual wave generating members can be operated either in phase or an out of phase relationship to create different kinds of waves as disclosed in that patent.

Figure 2:
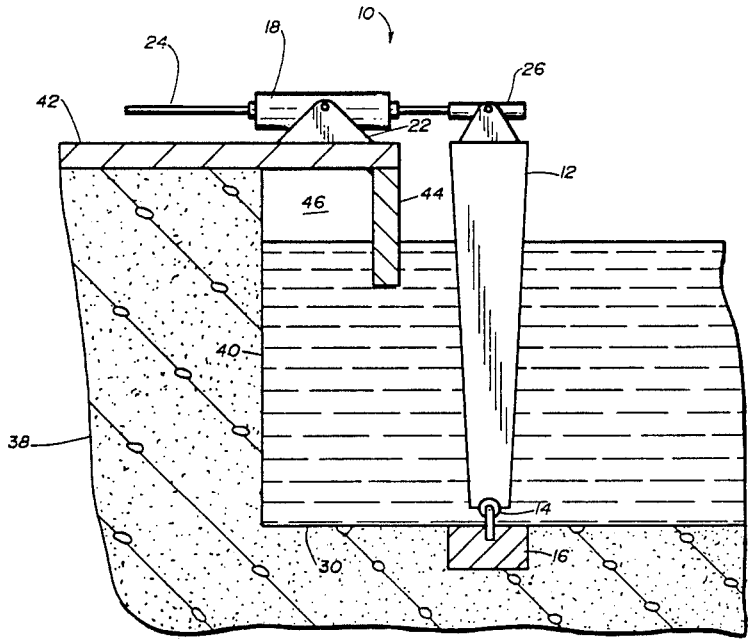
FIG. 2 is a fragmentary sectional view of a portion of FIG. 1 in larger scale illustrating the details of the wave generating and energy dissipation device of the present invention.

As illustrated in FIG. 2, which shows the wave generating member 12 at rest, the platform on which hydraulic cylinder 18 is mounted overhangs the pool. Extending downwardly from platform 42 is a baffle 44. Pool foundation 38, platform 42, and baffle 44 together form a chamber 46 which contains a pocket of air. As shown in FIG. 2, baffle 44 extends downwardly so that at least at some point during the return stroke of wave generating member 12, baffle 44 extends below the rising water level behind member 12 and seals chamber 46 so that compression of the air entrapped therein can occur. Platform 42 and baffle 44 can be formed of any suitable structural material. For example, platform 42 and baffle 44 can be formed of reinforced concrete and be formed at the same time as the formation of foundation 38. In a preferred embodiment, baffle 44 is a steel I-beam which can be secured to the underside of platform 42.

FIGS. 3 and 4 illustrate the operation of the wave generating device. The forward and return strokes of the wave generating device 10 are somewhat exaggerated for purposes of illustration. As shown in FIG. 3, hydraulic cylinder 18 and ram 24 cause wave generating member 12 to move forwardly in the direction shown by arrow 50 to a first forward position as illustrated. This causes water in front of the wave generating member 12 to build up and eventually form a wave as it travels over shoal 34. The water level behind wave generating member 12 drops as shown by arrows 54 to a level below the bottom edge of baffle 44. Air enters chamber 46 at this time. Alternatively, one or more valves or open ports (not shown) may be positioned either in baffle 44 or platform 42 to permit air to enter chamber 46.

As shown in FIG. 4, cylinder 18 and ram 24 then reciprocate to cause wave generating member 12 to return to a second position by moving in the direction shown by arrow 52. This causes the water level behind wave generating member 12 to rise as shown by arrow 56. Baffle 44 in combination with platform 42 and end wall 40 of the pool trap air in chamber 46. The return stroke of the wave generating member raises the level of water in chamber 46 causing the air trapped therein to be compressed. It has been found that this air compression effectively acts to dissipate the wave energy from the water generated by the return movement of the wave generating member. Potentially damaging vibrations, which were a problem in prior art devices, have been substantially eliminated by the present invention. Wave generating member 12 is cycled repetitively from the positions illustrated in FIGS. 3 and 4 to generate a series of waves in pool 20. On each return stroke, air in chamber 46 is compressed and acts to dissipate the wave energy generated.

Having described the invention in detail and by reference to preferred embodiments thereof, it will be apparent that modifications and variations are possible without departing from the scope of the invention defined in the appended claims.

What is claimed is:

1. A device for creating waves of water comprising:

a wave-generating member reciprocable from a first forward position to a second return position;

means for cyclically reciprocating said wave-generating member in water to create waves; and means positioned adjacent said second return position of said wave-generating member for dissipating wave energy from water generated by movement of said wave-generating member from said first position to said second position comprising a baffle forming a chamber containing air, said baffle trapping the water moved by the returning of said wave-generating member to said second position such that the force of said water compresses said air in said chamber to dissipate the wave energy generated.

2. The device of claim 5 in which said baffle extends below water level at some point during reciprocation of said wave-generating member.

3. The device of claim 1 in which said baffle extends below water level at some point during movement of said wave-generating member from said first position to said second position.

4. The device of claim 3 in which said baffle extends downwardly from a platform on which said means for cyclically reciprocating said wave-generating member is positioned.

5. The device of claim 1 in which said chamber includes means for controlling the escape of air from said chamber.

6. A method of generating a wave along a shoal in a body of water comprising the steps of:

generating a water wave by moving a wave-generating member forwardly to a first position to cause movement of water toward said shoal, returning said wave-generating member to a second position; and trapping the water moved by the returning of said wave-generating member to said second position behind a baffle forming a chamber containing air adjacent said second position and using the force of said water to compress the air in said chamber and dissipate the wave energy generated.

* * * * *